US006283182B1

(12) United States Patent
Fedeli

(10) Patent No.: US 6,283,182 B1
(45) Date of Patent: Sep. 4, 2001

(54) EJECTION DEVICE TO EXPEL OBJECTS FROM THE INSIDE OF A BAG IN THE EVENT OF A BAGSNATCHING

(76) Inventor: Benedetto Fedeli, 7 Av., San Reman, Principato di Monaco (IT)

( * ) Notice: Subject to any disclaimer, the term of this patent is extended or adjusted under 35 U.S.C. 154(b) by 0 days.

(21) Appl. No.: 09/502,243

(22) Filed: Feb. 17, 2000

(30) Foreign Application Priority Data

Dec. 16, 1999 (IT) ..... RM99A0759

(51) Int. Cl.[7] ..... A45C 13/18

(52) U.S. Cl. ..... 150/102; 383/3; 206/522; 441/94; 441/40

(58) Field of Search ..... 150/102; 383/3; 206/522; 221/64, 15; 141/10, 67, 114, 330; 222/5, 54; 441/93, 94, 96, 46, 41

(56) References Cited

U.S. PATENT DOCUMENTS 2,970,326 * 2/1961 Keefe ..... 441/96 X
3,132,626 * 5/1964 Reid ..... 441/23 X
3,727,657 * 4/1973 Landis ..... 150/102
4,044,867 * 8/1977 Fisher ..... 206/522 X
5,507,578 * 4/1996 Ozeri et al. ..... 206/522 X
6,032,709 * 3/2000 Fedeli ..... 150/102

* cited by examiner

*Primary Examiner*—Allan N. Shoap
*Assistant Examiner*—Tri M. Mai
(74) *Attorney, Agent, or Firm*—Bucknam and Archer

(57) ABSTRACT

Ejection device to expel objects from the inside of a bag in the event of a bag-snatching, the bag comprising an expandable sack below a lining (400), a compressed gas feeder (2) including an elongated housing (20) operatively connected to the expandable sack (1) and carrying, in sequence, a small gas bottle (6), a piercing bit (72), a release mechanism (8), a relative control means (3) with a Bowden cable transmission (30) connected to a handle (50) through a junction member (51) in two parts. A snatch, being transmitted to the handle (50), operates the release mechanism (8) and causes the expandable sack to be inflated (1) and then the two parts of the junction member (51) to be separated.

8 Claims, 5 Drawing Sheets

EJECTION DEVICE TO EXPEL OBJECTS FROM THE INSIDE OF A BAG IN THE EVENT OF A BAGSNATCHING

This invention relates to an ejection device to expel objects from the inside of a bag in the event of a bag-snatching.

The same applicant has filed a PCT patent application for a self-emptying bag before. Such a bag, in general a bag with a handle or a shoulder-strap, has an inner expandable sack that, when empty, is located on the bottom of the bag. A couple of ties are provided in the handle or the like among the end of the handle and a couple of fuses respectively connected to containers of compressed gas or air. These gas containers are connected to the expandable sack in the opposite direction with respect to the fuses. When a handbag-snatcher tries to snatch such a bag by pulling away either the bag handle or the same bag from a person wearing the bag, the ties activate the fuses in order that gas is fed from the containers into the expandable sack. The expandable sack, being inflated by the gas to a volume greater than the volume of the bag, expels objects in the bag from the inside of the bag to outside.

According to the patent application above cited, means known at that time could be used to manufacture the self-emptying bag. In particular, the existing feeders of compressed air or gas, that are provided e.g. on self-inflatable life-jackets, according to how they are designed, have a very slow operation in any case. This very slow operation is not suitable for the fast ejection that is required to spread quickly on the ground all the contents of a bag of a person being bag-snatched.

Further, according to the patent application above cited a generic weakness means of either the handle or the shoulder-strap is provided. Thus, it is necessary to develop weakness means which does not weaken the handle or the like but allows the handle to be quickly separated into two sections and next to be restored back into its original form readily and integrally.

In general, conventional means, which the bag according to the patent application known is provided with, then cause a not satisfactory operation of the bag.

Therefore, a main object of this invention is to allow an effective operation of a self emptying bag with respect to the fast inflation of the expandable sack and the subsequent complete ejection of the contents from the bag. Another object of this invention is to allow a safe release of a shoulder-strap or the like so that a person, when bag-snatched, does not suffer also physical damages.

According to this invention there is provided an ejection device to expel objects from the inside of a bag in the event of a bag-snatching, the bag comprising internally an expandable sack provided with a compressed gas feeder so that the expandable sack is able to be inflated from a wait condition wherein it is empty to an operated condition wherein the expandable sack is inflated to a volume greater than the internal volume of the bag, characterized in that:

- a lining is hold removably with its upper hem near the edge of the opening of a bag;
- an expandable sack is arranged on a base of the bag below the lining;
- a compressed gas feeder located below the expandable sack includes
  - a small gas bottle having a pierceable mouth;
  - an elongated housing frontally connected to the small gas bottle and on its upper part to the expandable sack, internally carrying a piecing element having a bit provided with an axial passageway communicating with said expandable sack through its hollow cylindrical body which is endowed with rear ports and is axially movable under a pre-charged spring,
  - a release mechanism of the pre-charged spring to push the piercing element, having an ogival release member removably retained by means of at least a retaining flexible thin plate to a cylindrical body in abutment upon an end wall of the housing opposed to the small gas bottle which are at the same time housed in said ports of the hollow body and in a circumferential groove of said cylindrical body, so that, when the ogival release member is moved away from the contact with the small balls, the small balls disengage both the hollow body and the cylindrical body releasing the piercing element against the pierceable mouth of the small gas bottle;
  - control means of said release mechanism comprise a Bowden cable transmission, having in the one of its ends a connection to the release member and in the other one a junction member to a portion of a bag designed to be held permanently by who wears the bag, so that a snatch, being transmitted to said portion of the bag through the Bowden cable transmission, operates the release mechanism and causes the expandable sack to be inflated until the lining is completely overturned.

Advantageously, said junction member is resoluble in the event of a bag-snatching so to separate the bag from the portion to be held permanently by who wears the bag.

Now the invention will be described with reference to its preferred embodiment, although it should be appreciated that modifications can be brought without departing from the scope of the invention, with connection to the enclosed drawing, wherein.

Figure 4:
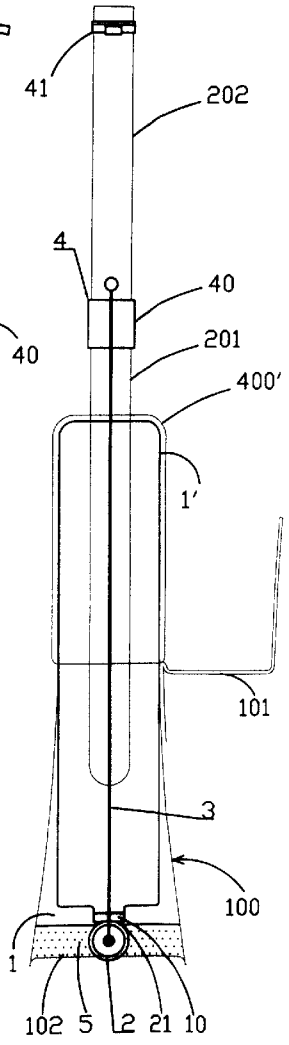
FIG. 4 is a diagrammatic side view of the ejection device in FIG. 3.
Figure 3:
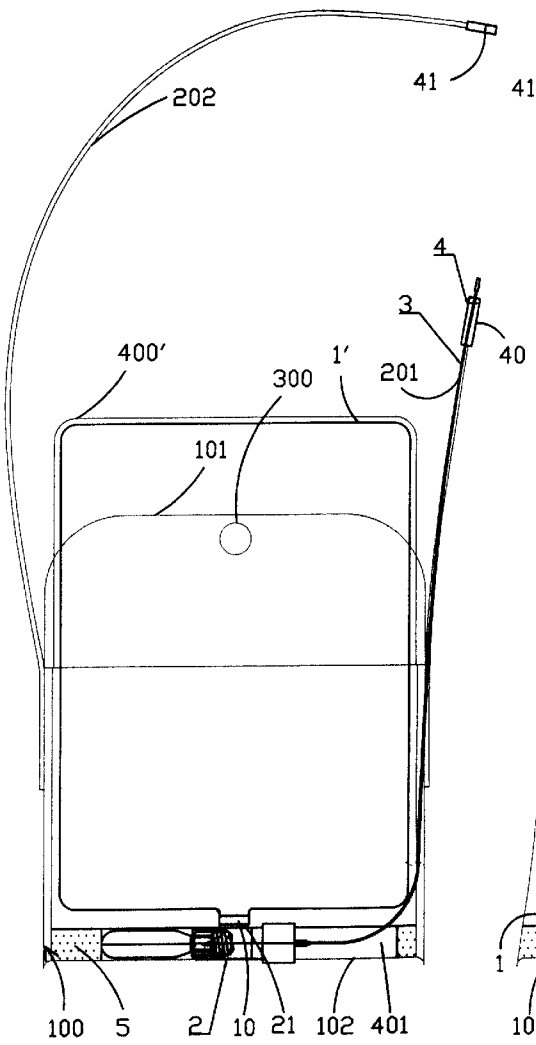
FIG. 3 is a diagrammatic, partially fragmentary, front view of the ejection device according to the invention in a operated condition in a consequently opened bag.

Referring to the ejection device is shown as a whole in FIGS. 1, 2 and 3, 4 in a wait condition and in an operated condition, respectively. A bag 100, to which the ejection device is applied, is depicted by fine lines in a closed position and in a next consequently opened position. By way of example, the bag 100 is endowed with a shoulder-strap 200. Even if the bag is shown as provided with a folding cover 101, this should not be considered in a limiting way. Further, with respect to closure means of the cover, that is diagrammatically shown in 300, it can be of any suitable kind, such as press-stud, Velcro (trademark) or the like, provided that it is yielding under the action of the ejection device according to the invention in order to allow the bag to be opened and its contents to fall down.

Conveniently the bag 100 is lined inside by a lining 400 shaped as a pocket that is preferably held, although this is not shown in the drawing, in its upper hem by the edge of the bag in a removable way, e.g. by means of a zip or so called Velcro. Thus, by opening the zip or moving away the edges of Velcro, a hand may enter easily a space 401 between the bottom of the lining 400 and the base 102 of the bag 100.

The ejection device according to the invention is located in the space 401. The ejection device comprises an expandable sack 1, a compressed gas or air feeder 2, control means having a Bowden cable flexible transmission 3 and a junction member 4 connecting two sections 201 and 202 of the shoulder-strap 200.

Figure 2:
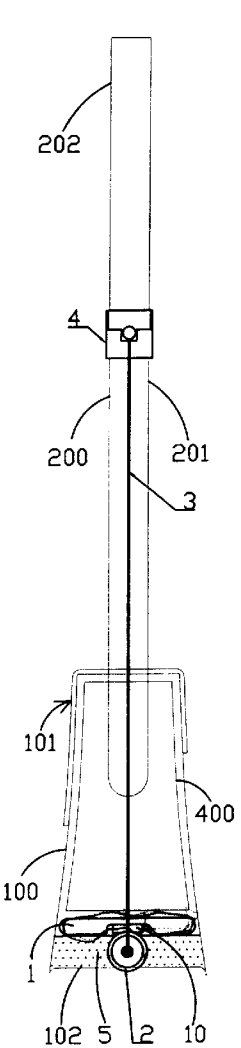
FIG. 2 is a diagrammatic side view of the ejection device in FIG. 1.
Figure 1:
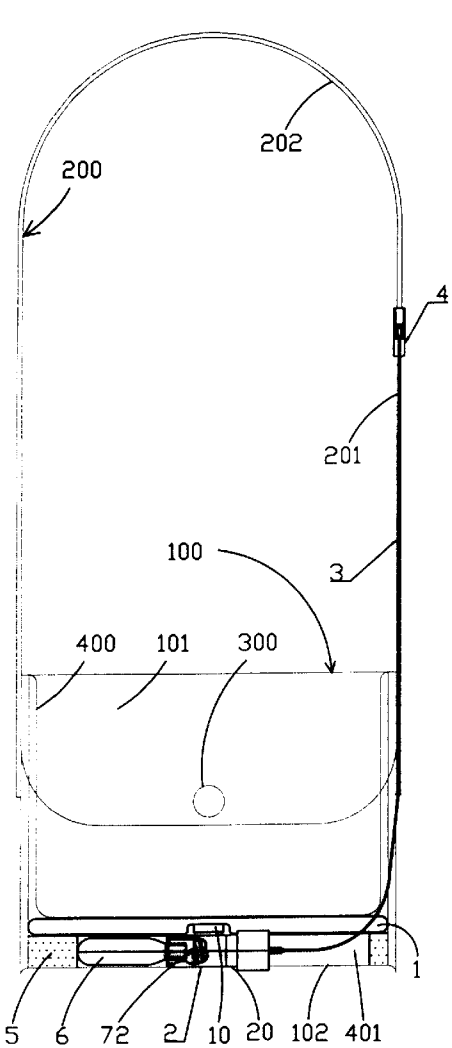
FIG. 1 is a diagrammatic, partially fragmentary, front view of the ejection device according to the invention in a wait condition, applied to a closed bag having a shoulder-strap depicted by a fine line.

The airtight expandable sack 1, diagrammatically depicted in its collapsed state in FIGS. 1 and 2, is arranged in a collected way, e.g. folded, under the lining 400. In this inflated state (FIGS. 3 and 4) the expandable sack 1' takes on the form of a prismatic body, or also cylindrical, so to be able to keep the lining 400 overturned in 400' as shown in the same figures.

At the bottom the expandable sack 1 is hermetically connected through its threaded locking ring 10 to a counter-threaded nozzle 21 projecting on the upper of an elongated housing 20 of the compressed gas feeder 2. The elongated housing 20 can be made of a suitable plastic material.

The compressed gas feeder 2 is located below the expandable sack 1, preferably arranged between restraint panels 5 e.g. of a suitable foamy plastic material, in order to prevent the compressed gas 2 from wandering troublesomely on the base 102 of the bag.

Figure 5:
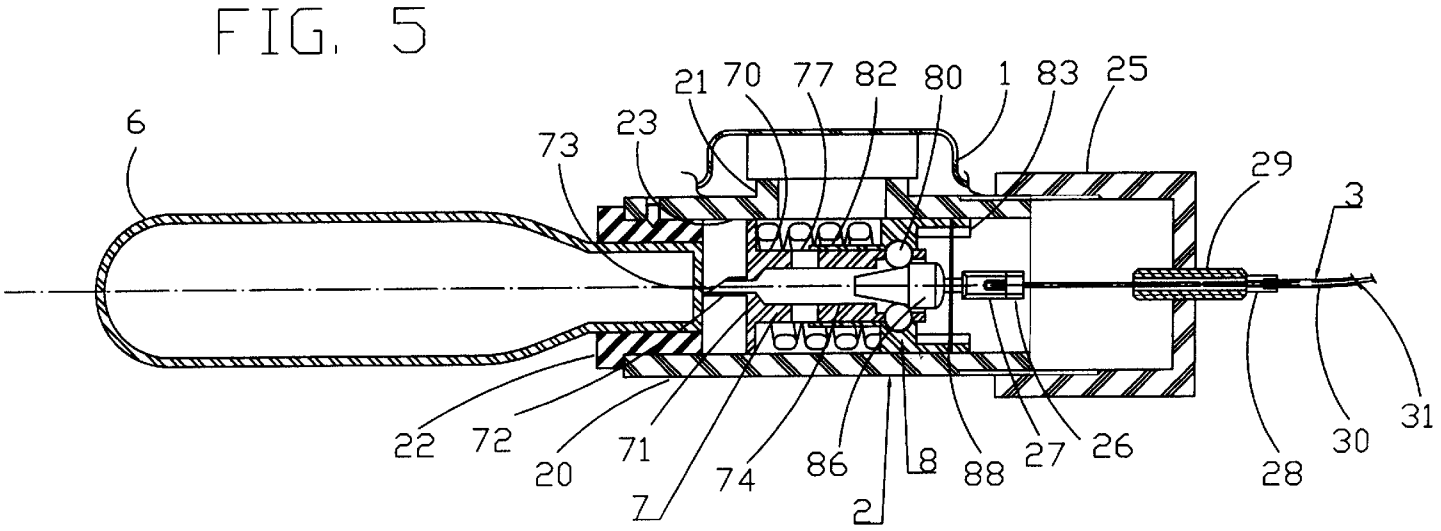
FIG. 5 is a longitudinal section of a compressed gas feeder of the ejection device according to the present invention in a wait condition.
Figure 6:
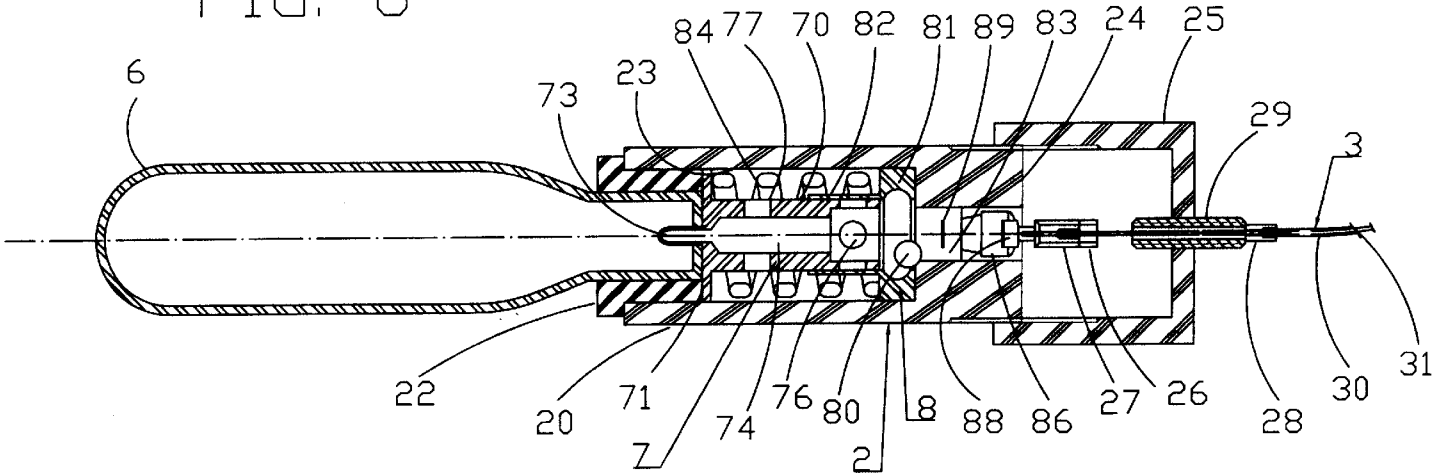
FIG. 6 is a longitudinal section, made by a plane at right angle to that of the section in FIG. 5, of the gas feeder in an operated condition.

As shown in FIGS. 5 and 6 that are longitudinal sections of the compressed gas feeder 2 made along mutually hortogonal planes, its elongated housing 20, operatively connected to the expandable sack 1 through the nozzle 21, frontally carries a small bottle 6 of compressed air or gas and, in a sequence from an end to the other end thereof, a spring-charged piercing element 7 and a release mechanism 8.

The small gas bottle 6, having pierceable sealed mouth, is screwed to the elongated housing 20 by means of a both internally and externally threaded bushing 22, blocked in a fixed position. If the ejection device according to the present invention is destined to a normal size having, the small gas bottle must be selected so to inflate the expandable sack 1 to an adequate internal pressure. Thus the expandable sack 1 will be able with its expansion to exert a sufficient force to expel objects contained inside the bag 100 between the lining 400 and the bag cover 101 upon the opening of the closure means and the overturning of the cover. As it is obvious, the gas bottle 6 is chosen according to design requests and the kind of the bag.

Figure 7:
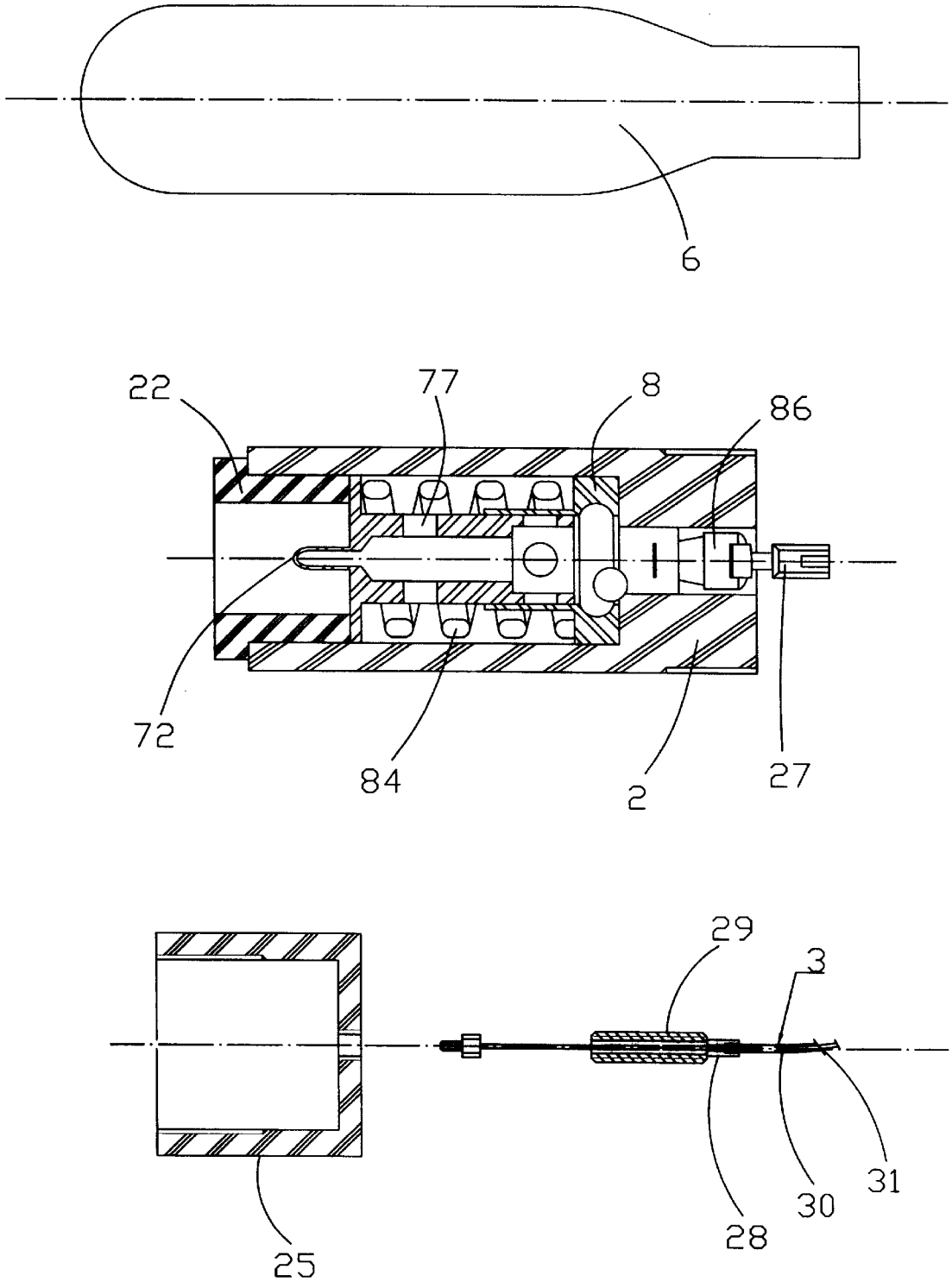
FIG. 7 is a longitudinal section of the parts of which the compressed gas feeder, disassembled in order to be subsequently restored, is comprised.
Figure 10:
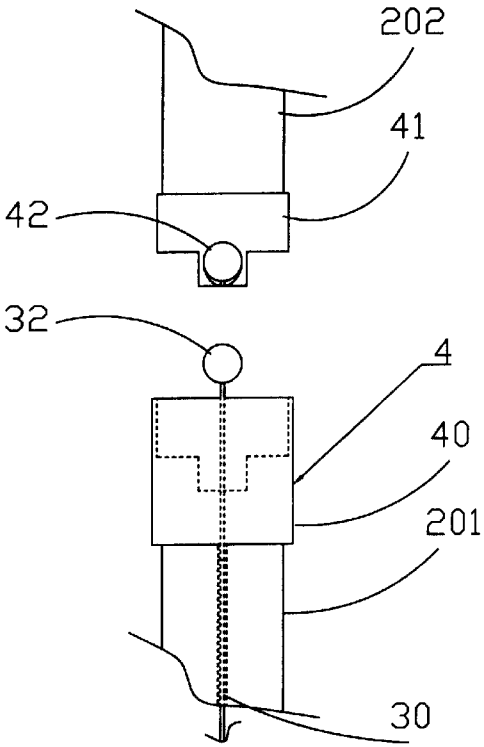
FIGS. 8, 9 and 10 are partial side views of a junction member of the ejection device according to the invention in a closed position, in an opened position after the compressed gas feeder is operated, and in a position wherein the junction member is separated in two parts, respectively.
Figure 9:
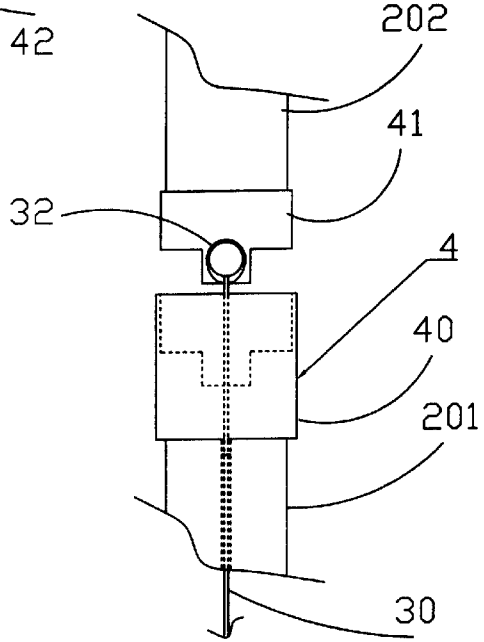

The gas bottle 6 is closed in its mouth by a septum that is easily pierceable by the piercing element 7. Referring to FIGS. 5 and 6, the piercing element 7, made of metal, has a hollow cylindrical body 10, comprising, in its side towards the gas bottle 6, a flange 71 sliding inside a cavity 23 of the housing 20 and a piercing bit 72. The piercing bit 72, preferably as a mouthpiece of a flute, is shaped so that the cut portion of septum remains laterally attached to the septum, without obstructing the emission of gas. In addition, the piercing bit 72 has an axial passageway 73 communicating with a channel 74 extending inside the hollow body 70. The hollow body 70 is lightened by holes 77 or passage slot towards the nozzle 21 communicating with the expandable sack 1. Further, the hollow body 70 ends rear with a thin section provided with radial ports 76 (e.g. four ports as shown in FIGS. 6 and 7) passed through small retaining balls 80 of the release mechanism 8, that are received inside the circumferential groove of the cylindrical body 81.

The release mechanism 8, comprising the cylindrical body 81 receiving the small balls 80, is in abutment on the internal surface of a transversal end wall 24 of the housing 20 (as seen in FIG. 6). This transversal wall 24 narrows the internal cavity of the housing 20 to a prismatic space. The cylindrical body 81 has in its part towards the gas bottle 6 a guide sleeve 82 of the hollow cylindrical body 70 of the piercing element 7 and in its rear part at least two diametrically opposite longitudinal tabs 83, 83, whose function will be explained below.

A spiral spring 84 is abutted between the cylindrical body 81 of the release mechanism 8 and the flange 71 of the piercing element 7. The spring 84 is shown in its contracted state (charged) in FIG. 5 and in its extended state in FIGS. 6 and 7.

In the internal circumferential groove of the cylindrical sleeve 81 the small balls 80, in the wait condition of the release mechanism, are retained in the radial ports 76 of the hollow body 70 against the external conical surface of a release member 86 having an ogival shape, i.e. frustoconical-cylindrical, provided with a short stem. The ogival release member 86 is connected to the Bowden cable flexible transmission 30 of control means 3. Advantageously, the connection between the ogival release member 86 and the Bowden cable 30 takes place through a male-female threaded coupling 26–27, which is provided on the one hand on the strand 31 of the Bowden cable 30 and on the other hand on the short stem of the ogival release member 86. Such a coupling 26–27 is preferably contained within a cylindrical space limited by a portion of the externally threaded end wall 24 of the housing 20, and by a facing internally threaded cover 25 screwed on the end wall 24. The cover 25 has a threaded hole on its base opposed to the gas bottle 6 designed for an externally threaded sleeve, which diagrammatically represents adjusting means of the Bowden cable 30.

At least a retaining thin plate 88, designed to engage removably diametrical opposite seats 89 in the longitudinal tabs 83, 83 of the release mechanism 8, is fitted on the cylindrical stem of the ogival member 86.

In the end opposed to the ogival member 86 the Bowden cable transmission 30 is connected to the junction member 4. The junction member 4 is comprised of first and second parts 40, 41, that are loosely fitted the one into the other one. The parts 40, 41 are joined to the ends of first and second sections 201, 202 of the shoulder-strap 200 respectively. As shown in FIGS. 1 to 4, the strap sections 201 and 202 are chosen so long that the junction member 4 is placed in front of that who wears the bag, if he or she is not left-handed. If the bag were carried on the left side, it would be suitable that the section 201 is longer than the section 202, otherwise control means can be inefficient, as it will be understood from the following of the description. Suitably, the sections 201 and 202 can have the same length.

Figure 11:
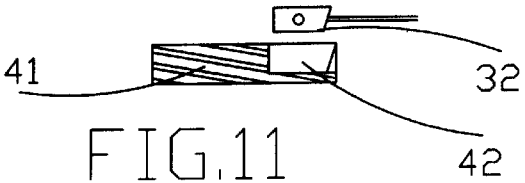
FIG. 11 is an enlarged longitudinal section of an end of control means far from the compressed gas feeder.
Figure 8:
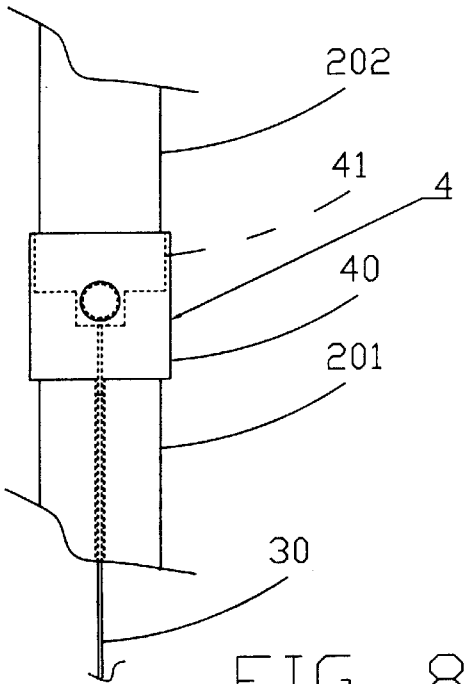

As shown in FIGS. 1 to 4, the Bowden cable transmission 30 passes inside through the first strap section 201 and is retained removably by a dowel or pawl 32, e.g. having a discoid or prismatic shape, in a corresponding seat 42 made in the second part 41 of the junction member 4 joined to the section 202 of the shoulder-strap 200 (FIGS. 8 to 11). In FIG. 11 the pawl 32 is shown as tapered towards the seat 42 in the side provided with a slot towards the strand 31. Accordingly, the seat 42 is enlarged upwards, in order to promote the disengagement between the pawl 32 and the seat 42.

In operation, a snatch applied on the shoulder-strap 200, having an intensity larger than a minimum fixed through the choice of the strength of said retaining thin plate 88, when the junction member is closed (FIG. 8), firstly is transmitted, through the removal of the two parts 40, 41 of the junction member 4 (FIG. 9), to the Bowden cable transmission 30 in the first strap section 201. As shown in FIG. 6, the ogival release member 86, when the thin plate 88 leaves its seat 89, moves away from the cylindrical body 81 of the release mechanism 8, causing the small balls 80 to leave the respective seats, and the spring 84 of the piecing element 7 to release. The subsequent fast run of the Bowden cable 30 brings about the separation of the two parts 40, 41 of the junction member 4 (FIG. 10) due to the fact that the pawl 32 of the end of the Bowden cable 30 leaves the seat 42 of the part 41 of the junction member 4.

In operation, i.e. when the release mechanism goes from the state shown in FIG. 5 to that in FIG. 6, the release of the piercing element 7 towards the small gas bottle 6, by virtue of the spring 84 not more retained along the body 70 of the piercing element 7, causes the small gas bottle to be pierced.

The compressed gas is discharged through the axial passageway of the piercing bit 72, the channel of the hollow body 70 and then through the side holes 77 or slots into the nozzle 21 to inflate the expandable sack 1 to 1' with subsequent opening and emptying out of the bag. At this time, the bag-snatcher should collect one after the other the objects that came out from the bag. As one can understand very well, to collect the objects is an unrealizable operation and the bag-snatch is frustrated without any risk for that who wears the bag.

Figure 12:
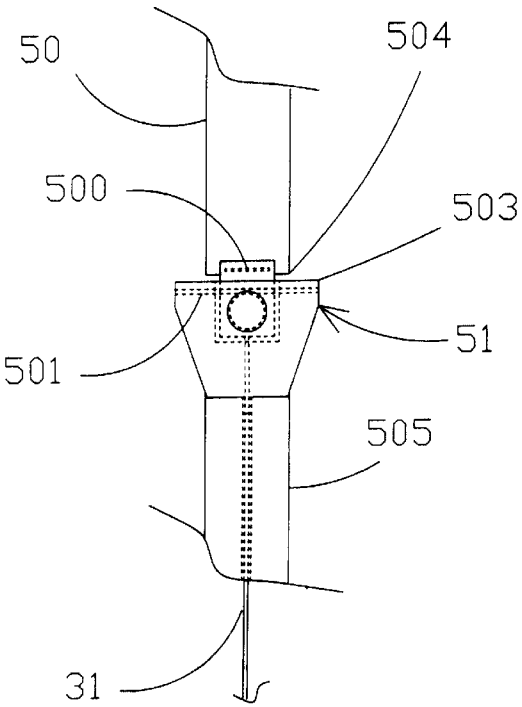
FIG. 12 is a partial side view of a modified junction member of the ejection device according to the invention in a closed position.

With reference to FIG. 12 a modified resolvable junction member is shown. Such a junction member can be embodied into a bag with a handle shown in FIG. 13, but it can be embodied also into a shoulder-bag in FIG. 1 to 4. The junction member in FIG. 12, indicated as 51, is also comprised of two separable parts, 500, 503, each being retained to the other by a pawl of the Bowden cable in the respective seat, as shown by dash lines in the closed position of the junction member. In this closed position, the two parts 500, 503 are further mutually retained by at least a shear pin 501 housed in coaxial through holes in the two parts 500, 503.

The choice of the suitable resistance to shearing stress of the pin 501 allows that only some stresses on the handle or on the shoulder-strap are applied, through the Bowden cable transmission 30, to the retaining plate 88. If the retaining plate 88 has been strained subsequently, a pull on the ogival member 86 of the release mechanism 8 sufficient to cause the piercing element 7 to be released and the compressed gas to leave undesirably the small gas bottle 6 can take place.

Figure 13:
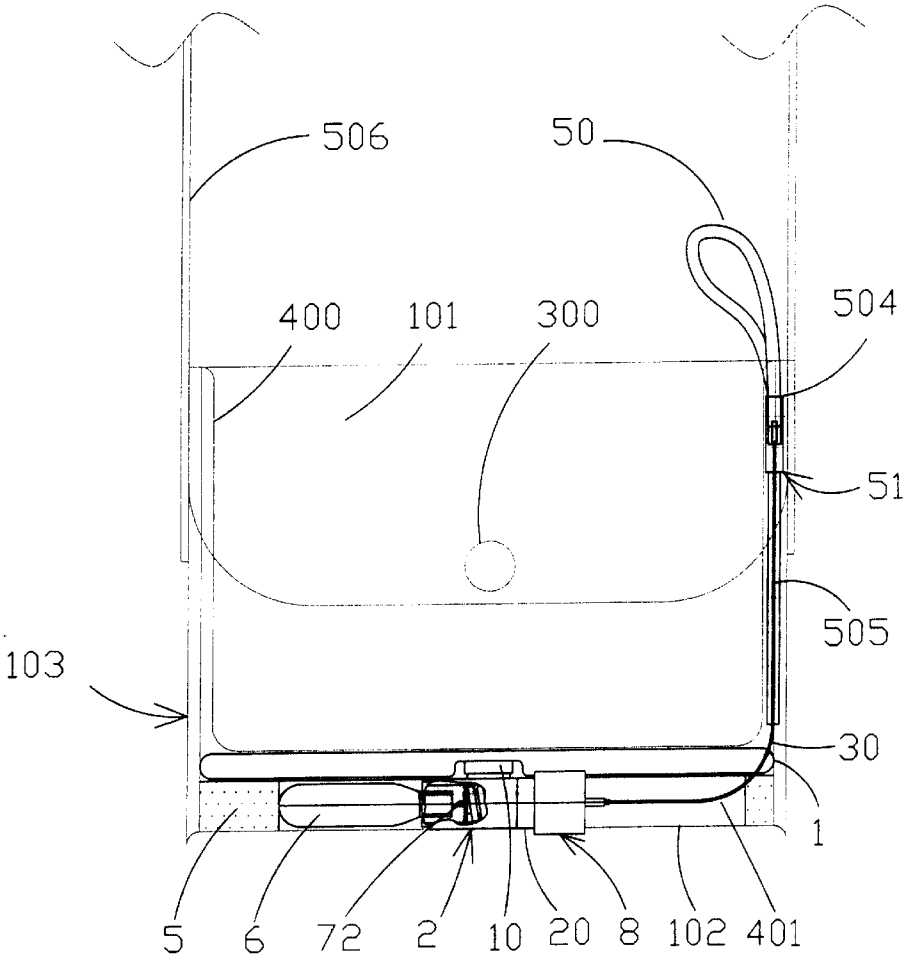
FIG. 13 is a diagrammatic, partially fragmentary, front view of the ejection device according to the invention in FIG. 1 in a wait condition, applied to a closed bag having a handle depicted by a fine line.

Referring to FIG. 13, as shown, the ejection device of the present invention is embodied into a bag 103 provided with a handle 50. Similar parts to those of the shoulder bag are designated by the same reference numerals. In particular, the two resoluble parts 500, 503 are inserted the one into the other and are joined to the end of a thong 505 inside the bag 103 and to the end 504 of the handle 50 respectively.

The bag can be permanently retained through the handle 50 for a greater safety of the person who wears the bag. Any attempt of bag-snatching causes the release mechanism 8 to be operated with the subsequent inflation of the sack 1 so to empty immediately the bag of its contents. The bag 103 can be provided with a strap 506. In order to prevent that the grip of this shoulder-strap can hinder the operation of the release mechanism 8, the strap 506 has at its ends readily resolvable connection means, such as Velcro or press-studs. The strap 506 however can be used either as a shoulder-strap or also as a comfortable flexible handle.

The advantages of the ejection device according to the invention above all consist of the quickness of inflation of the expandable sack by virtue of the fast inflow of compressed gas through the axial passageway of the bit, the reliability of the end release mechanism and the efficacy of the junction member of the strap or handle.

Further, as shown in FIG. 7, for restoring the ejection device in the bag one has only to unscrew the cover 25 from the housing 20, to separate the male-female coupling 26–27 between Bowden cable 30 and ogival member 86, to get a piercing element-release mechanism unit 7–8 reconditioned and recharged as shown in FIG. 5 and a new small gas bottle 6, and to screw again the male 26 of the Bowden cable 30 on a release member 86 of such a reconditioned unit. After screwing again the male-female coupling, also the cover 25 can be screwed again into wall 24 of the housing 20 to protect the operation of the Bowden cable, assuring its efficiency.

What is claimed is:

1. An ejection device for a bag to expel objects from the inside of the bag in the event of a bag-snatching, the bag comprising internally an expandable sack provided with a compressed gas feeder so that the expandable sack is inflated from a wait condition wherein it is empty to an operated condition wherein the expandable sack is inflated to a volume greater than the internal volume of the bag, said bag ejection device comprising:

a lining (400) removably held with its upper hem near the edge of the opening of a bag (100; 103);

an expandable sack (1) arranged on a base (102) of the bag (100;103) below the lining (400);

a compressed gas feeder (2) disposed below the expandable sack (1) and which includes a small gas bottle (6) having a pierceable mouth;

an elongated housing (20) connected at a front part to the small gas bottle (6) and on an upper part to the expandable sack (1), said housing including a piercing element (7) having a bid (72) provided with an axial passageway (73) communicating with said expandable sack (1) through its hollow cylindrical body (70) which has rear ports (76) and is axially movable by the pressure of spring (84);

a release mechanism (8) for releasing spring (84) to push the piercing element (7), having an ogival release member (86) removably retained by means of at least a retaining flexible thin plate (88) to a cylindrical body (81) in abutment upon an end wall (24) of the housing (20) opposed to the small gas bottle (6) and small balls (80) which are at the same time housed in said ports (76) of the hollow body (70) and in a circumferential groove of said cylindrical body (81), so that, when the ogival release member (86) is moved away from the contact with the small balls, hollow body (70) disengages from cylindrical body (81) releasing the piercing element (7) against the pierceable mouth of the small gas bottle (6);

means (3) for controlling said release mechanism (8) comprising a bowden cable transmission (30), having at one of its ends a connection to the release member (86) and at another end a junction member to a portion of a bag (100; 103) designed to be held by the wearer of the bag, so that a snatch, being transmitted to said portion of the bag through the bowden cable transmission (30), operates the release mechanism (8) and causes the expandable sack to be inflated until the lining is completely overturned.

2. The ejection device for a bag according to claim 1, wherein said connection of the bowden cable transmission (30) to the release member (86) comprises a male-female threaded coupling (26–27) contained inside a cylindrical space partially defined by said end wall (24) of the housing (20), which is externally threaded, and a facing cover (25) which is internally threaded; adjustment means of the bowden cable transmission (30) being provided in a through hole of the end part of the cover (25).

3. The ejection device for a bag according to claim 1, wherein said junction member is resoluble junction means (4;51) in the event of a bag-snatching, being constituted by two separable parts.

4. The ejection device for a bag according to claim 3, wherein said resoluble junction means (4;51) in the event of a bag-snatching is comprised of two separable parts mutually retained by at least a shear pin (501).

5. The ejection device for a bag according to claim 1, wherein said portion of the bag (100) designed to be retained by the wearer of the bag is a shoulder-strap (200), and said bowden cable transmission (30) has the end opposed to the release member (86) that is connected to said junction member (4) formed by two resoluble parts (40, 41), that are inserted one into the other and joined to the ends of first and second sections (201, 202) of said shoulder-strap respectively;

said bowden cable transmission (30) passing through said first strap section (201) and being retained removably by a pawl (32) thereof which is tapered towards the pull side of the bowden cable transmission (30) in a corresponding seat (42) formed in said part (41) of the junction member joined to the second strap section (202) and surrounded by said part (40) of the first strap section (201), when the junction member is closed; so that a snatch applied on the shoulder-strap (200) is first transmitted to the bowden cable transmission (30) in the first strap section (201) for operating the release mechanism (8) and causing the expandable sack to be inflated until the lining is completely overturned (400'), and next for releasing the tapered pawl (32) of the bowden cable transmission (30) from its seat (42) in the part (41) of the junction member (4) which is joined to the second strap section (202).

6. The ejection device for a bag according to claim 4, wherein the first strap section (201) is of the same length as the second strap section (202).

7. The ejection device for a bag according to claim 1, wherein said portion of the bag (103) designed to be held by the wearer of the bag is a handle (50) and said bowden cable transmission (30) has the end opposed to the release member (86) that is connected to said junction member (51) formed by two resoluble parts (500, 503) that are inserted one into the other and joined to the end of a thong (505) inside the bag (103) and to an end (504) of the handle (50) respectively;

said bowden cable transmission (30) passing inside through said thong (505) and being retained removably by a pawl thereof which is tapered towards the pull side of the bowden cable transmission (30) in a corresponding seat made in said part (500) of the junction member (501) joined to the handle (50) and surrounded by said part (503) of the junction member (51), when the junction member (51) is closed;

so that a snatch applied on the bag, is first transmitted through the handle (50) to the bowden cable transmission (30) on the thong (505) for operating the release mechanism (8) and causing the expandable sack to be inflated until the lining is completely overturned (400'), and next for releasing the tapered pawl of the bowden cable transmission (30) from its seat in the part (500) of the junction member (51) which is joined to the handle (50).

8. The ejection device for a bag according to claim 7, wherein said handle (50) is shaped as a loop connected to a fast release strap (506) of the bag.

* * * * *